US005421114A

United States Patent [19]

Bond et al.

[11] Patent Number: 5,421,114

[45] Date of Patent: Jun. 6, 1995

[54] GUN WITH IMPROVED BARREL LOCKING MEANS AND REBOUNDING HAMMER

[75] Inventors: Gregory E. Bond, 704 N. Rita, Waco, Tex. 76705; Paul M. Neslony, Waco, Tex.; Robert B. Cotham, III, Decatur, Tex.

[73] Assignee: Gregory E. Bond, Waco, Tex.

[21] Appl. No.: 178,821

[22] Filed: Jan. 7, 1994

[51] Int. Cl.[6] ..... F41A 3/58; F41A 19/13; F41A 19/14

[52] U.S. Cl. ..... 42/42.03; 42/41; 42/44; 42/69.01

[58] Field of Search ..... 42/41, 42.01, 42.02, 42/42.03, 44, 40, 65, 69.01

[56] References Cited

U.S. PATENT DOCUMENTS

| | | | |
|---|---|---|---|
| 51,440 | 12/1865 | Elliot | 42/42.03 |
| 125,775 | 4/1872 | Whitmore | 42/44 |
| 140,516 | 7/1873 | Marlin | 42/65 |
| 402,423 | 4/1889 | Ehbets | 42/65 |
| 640,070 | 12/1899 | Aeschbacher | 42/65 |
| 1,434,628 | 11/1922 | Petrik | 42/41 |
| 3,209,480 | 10/1965 | Mittelsteadt | 42/41 |
| 3,276,158 | 10/1966 | Johnston | 42/43 |
| 3,740,885 | 6/1973 | Leaman | 42/65 |
| 4,625,443 | 12/1986 | Beretta | 42/65 |
| 5,095,643 | 3/1992 | Fisher | 42/44 |

FOREIGN PATENT DOCUMENTS

| | | | |
|---|---|---|---|
| 535393 | 4/1922 | France | 42/44 |
| 617983 | 3/1927 | France | 42/41 |
| 1051681 | 10/1955 | France | 42/44 |
| 1128692 | 1/1957 | France . | |
| 1248486 | 11/1960 | France | 42/41 |
| 525083 | 4/1955 | Italy | 42/44 |

*Primary Examiner*—Stephen M. Johnson
*Attorney, Agent, or Firm*—Richard C. Litman

[57] ABSTRACT

An improved gun design is disclosed which includes a highly effective and accurate hammer rebounding mechanism and a safe and efficient locking mechanism for securing the barrel of a breech load gun to the frame. Particularly, the rebounding mechanism encompasses a torsion spring device which controls the hammer of the pistol to effectuate an automatic hammer rebound after firing. There is also included a procedure to assure proper rotation of the hammer and a procedure to maintain the hammer in its rebounded position when the gun is at rest. The locking mechanism of the present invention increases the ease and speed with which the barrel can be moved into a loading position. Another feature of this locking lever is that if excessive force is applied to the locking lever in an attempt to unlock the barrel from the frame, an accidental discharge from a fully cocked hammer will be prevented.

17 Claims, 7 Drawing Sheets

GUN WITH IMPROVED BARREL LOCKING MEANS AND REBOUNDING HAMMER

BACKGROUND OF THE INVENTION

1. Field of the Invention

The present invention relates to improvements in the construction of guns and in particular to improvements, among others, in a mechanism for effectuating the rebounding of a hammer after firing and a locking mechanism for securing a barrel to the frame of a breech load pistol. These improvements make the pistol more efficient to use and also minimize the threat of accidental discharge.

2. Description of the Prior Art

The configuration of many guns in the prior art includes a firing pin extending from either the gun frame or the gun hammer. U.S. Pat. No. 51,440 issued to Elliot on Dec. 12, 1865 (the original Remington derringer patent) discloses a breech load gun having a firing pin connected to and protruding from the hammer. When the barrel of this type of gun is moved into the firing position, there is a danger that the protruding firing pin can contact the ammunition stored within the barrel. Therefore, to prevent accidental discharge, the hammer must be manually returned to its half-cocked position before moving the barrel into the firing position.

A common subject of the prior art is an automatic hammer rebound mechanisms which assure that ammunition cannot be contacted when loading a gun. These mechanisms are frequently connected to the trigger which supports the hammer in its cocked state. When the trigger is pulled, the hammer is released. Forces applied to the hammer by a hammer spring propel the hammer in the direction of the firing pin. Once the hammer encounters the pin and the gun is fired, the rebounding mechanism returns the hammer to a position where it is no longer in contact with the firing pin.

One example of a hammer rebounding device is seen by U.S. Pat. No. 4,625,443 issued to Beretta on Dec. 2, 1986 which includes a tripping mechanism for a four barreled pistol. Included in this tripping mechanism is a method to hold the hammer in a cocked position when the trigger is at rest. Beretta incorporates a disengaging tappet which acts against a lever. This lever then acts against the hammer to force the hammer back to its cocked position. This type of mechanism requires the precise interaction of many elements, each of which must exert pressure on an adjacent element. The successive interaction of these elements increases the likelihood that the rebounding mechanism will fail, as each component must work precisely to supply force on an adjacent component. Therefore, a simple and uncomplicated hammer rebounding means is desired.

The need for an efficient hammer rebounding mechanism is especially necessary in breech load guns where the firing pin protrudes into the barrel. Upon closure of the barrel to the firing position, there is a high risk that a protruding firing pin could ignite live ammunition, thus causing an accidental discharge.

Another topic of the present invention which is also the subject of prior art is a locking mechanism for securing the barrel of a breech load hand gun to a frame. Such breech load guns typically employ a barrel with a breech end pivotally attached to a gun frame. This type of attachment is seen by French Pat. No. 1.128.692 issued to Michler on Jan. 9, 1957 which shows a gun stock and barrel pivotally secured by a screw attachment. Such an attachment allows the barrel to be rotated between the loading and firing positions. When in the firing position, it is of great importance that a secure locking means holds the barrel to the frame. Many different methods are currently used to accomplish this connection. One such means is shown in U.S. Pat. No. 5,095,643 issued to Fisher on Mar. 17, 1992 which discloses the use of two longitudinal slots of substantially rectangular cross-sectional shape. One of these slots is cut into the receiver while the other slot is cut into the frame at a location where it will abut the receiver slot. The receiver is then secured into place by the use of a lug which is moved from the slot of the frame to the slot of the receiver.

Another configuration of a barrel locking means is shown in the Elliot patent. This locking mechanism consists of a circular rod transversely mounted in the gun frame. Half of the rod diameter has been cut away allowing the barrel lug to have clearance when the barrel is rotated away from the frame. To unlock the barrel from the frame, the locking lever handle must be rotated approximately 180 degrees.

These types of locking mechanisms often prove inefficient and awkward to use as manufacturing inadequacies or wear frequently result in excess play between the lug and the slots. The result is a loose contact between the barrel and frame. Also, if there is excessive powder build up on the breech of the barrel, the barrel to frame contact may not be flush, but the lug may still be able to inadequately lock the barrel to the frame. Therefore, the gun will still be capable of firing thus creating an extremely dangerous condition.

None of the above inventions and patents, taken either singly or in combination, is seen to describe the instant invention as claimed.

SUMMARY OF THE INVENTION

Accordingly, it is an object of the invention to provide new and novel means to effect the post firing rebounding of the hammer to a position where it is out of contact with the firing pins.

It is another object of the invention to provide means to prevent undesirable movement of the hammer head which will hinder the rebounding mechanism from working efficiently.

It is another object of the invention to increase the ease and speed of loading and unloading the gun through a novel design of the barrel locking means.

It is a further object of the invention to provide an improved means to secure the barrel and frame in a firing position such that variations in barrel types and manufacturing tolerances will not affect the accuracy and effectiveness of the gun.

Still another object of the invention to provide a device which prevents the gun from firing when there is excessive powder build up on the breech of the barrel.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
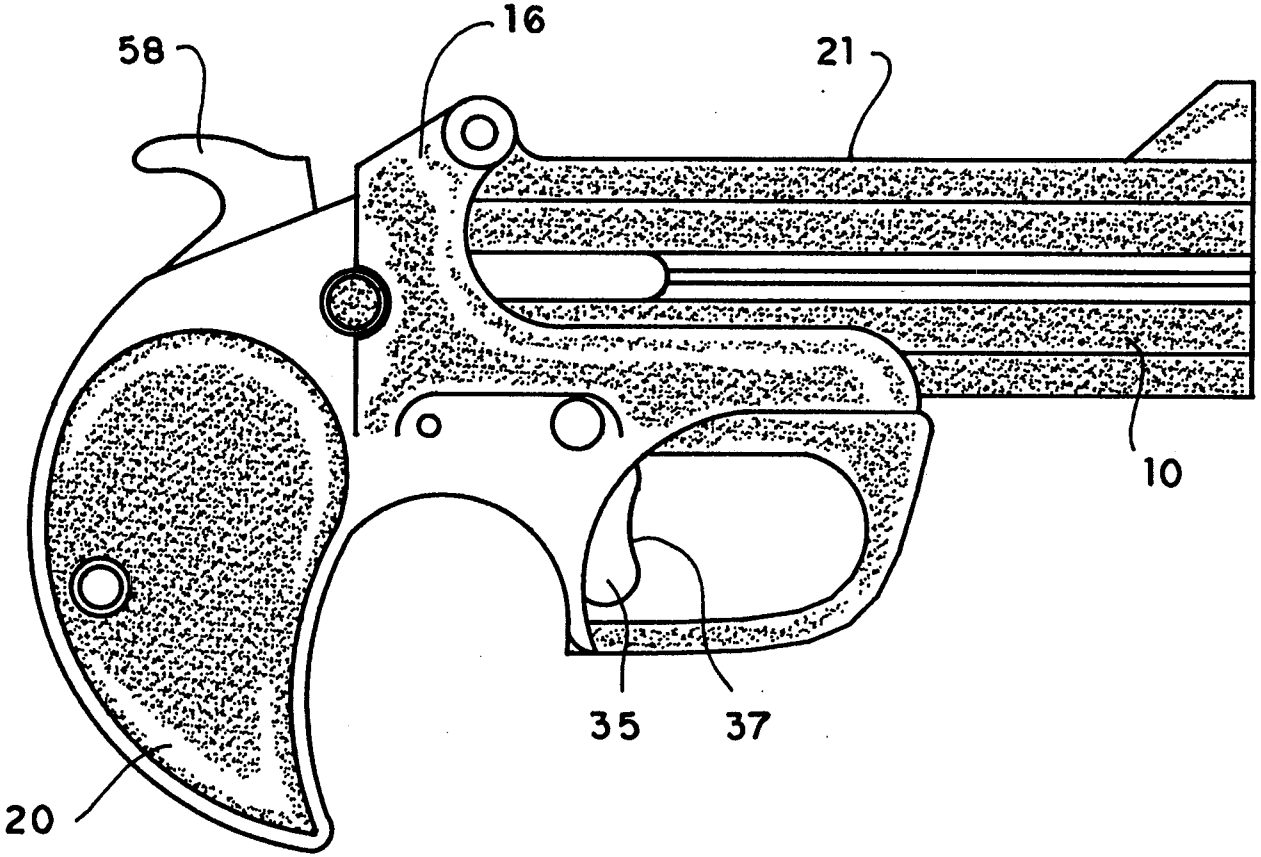
FIG. 1 is a right side elevational view of an improved gun according to the present invention.
Figure 2:
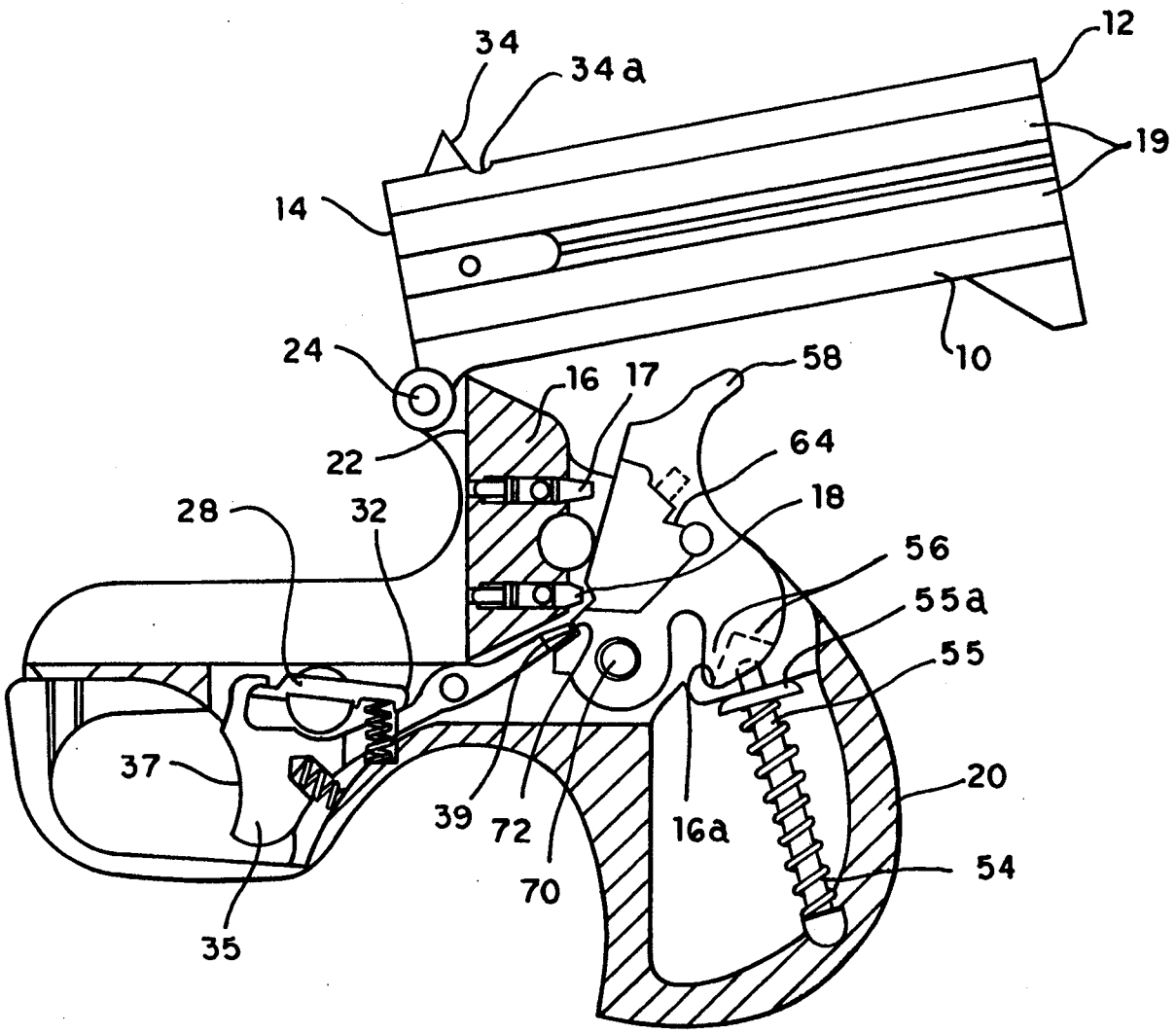
FIG. 2 is a side view in cross section of the gun of FIG. 1 in the loading position.
Figure 8:
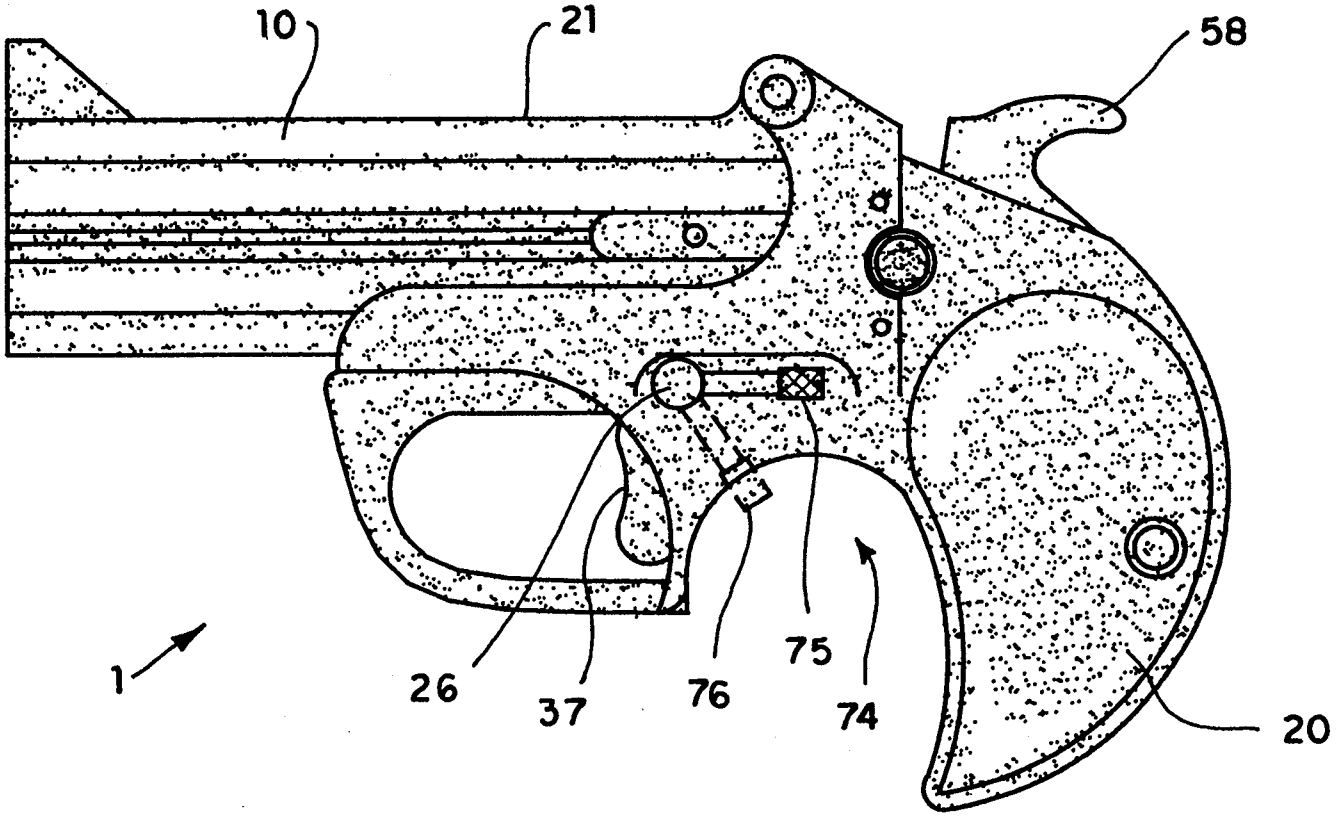
FIG. 8 is a left side elevational view of the gun of FIG. 1 showing the locking lever handle.

Referring now to the drawings there is illustrated a single action gun of the breech opening type as depicted in FIG. 1. The gun 1 includes a frame 16, a barrel 10, a hammer 58, and a trigger 35. As shown in FIG. 2, the frame 16 has a barrel receiving portion 22 and a handle 20. The barrel 10 has a muzzle end 12 and a breech end 14. In the preferred embodiment, the barrel 10 is pivotally attached to the frame 16 by a pivot pin 24 so that the barrel 10 and the frame 16 can be pivoted from a firing position, where the breech end of the barrel 14 abuts the receiving portion of the frame 22, to a loading position for removing a spent round or loading the gun. The firing position can be seen in FIG. 8 while the loading position is shown in FIG. 2.

Figure 5:
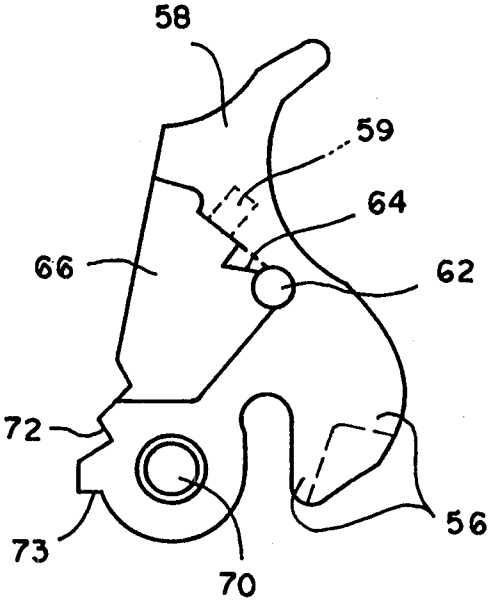
FIG. 5 is a side elevation view of the hammer of the gun of FIG. 1.

The barrel 10 has incorporated therein two bores 19 that extend through the barrel 10 and have discharge openings at the muzzle end 12 of the barrel 10 and rearward openings at the breech end 14 of the barrel 10. Two firing pins 17 and 18 extend from the frame and neighbor the breech end 14 of the barrel 10. A hammer 58 is pivotally attached at 70 to the frame 16. As shown in FIG. 5, the hammer is equipped with a hammer head cavity 66. This hammer head cavity 66 houses a hammer head 60, shown in FIG. 6, which is rotatable within the hammer head cavity 66 about a hammer head pivot pin 62.

Figure 3:
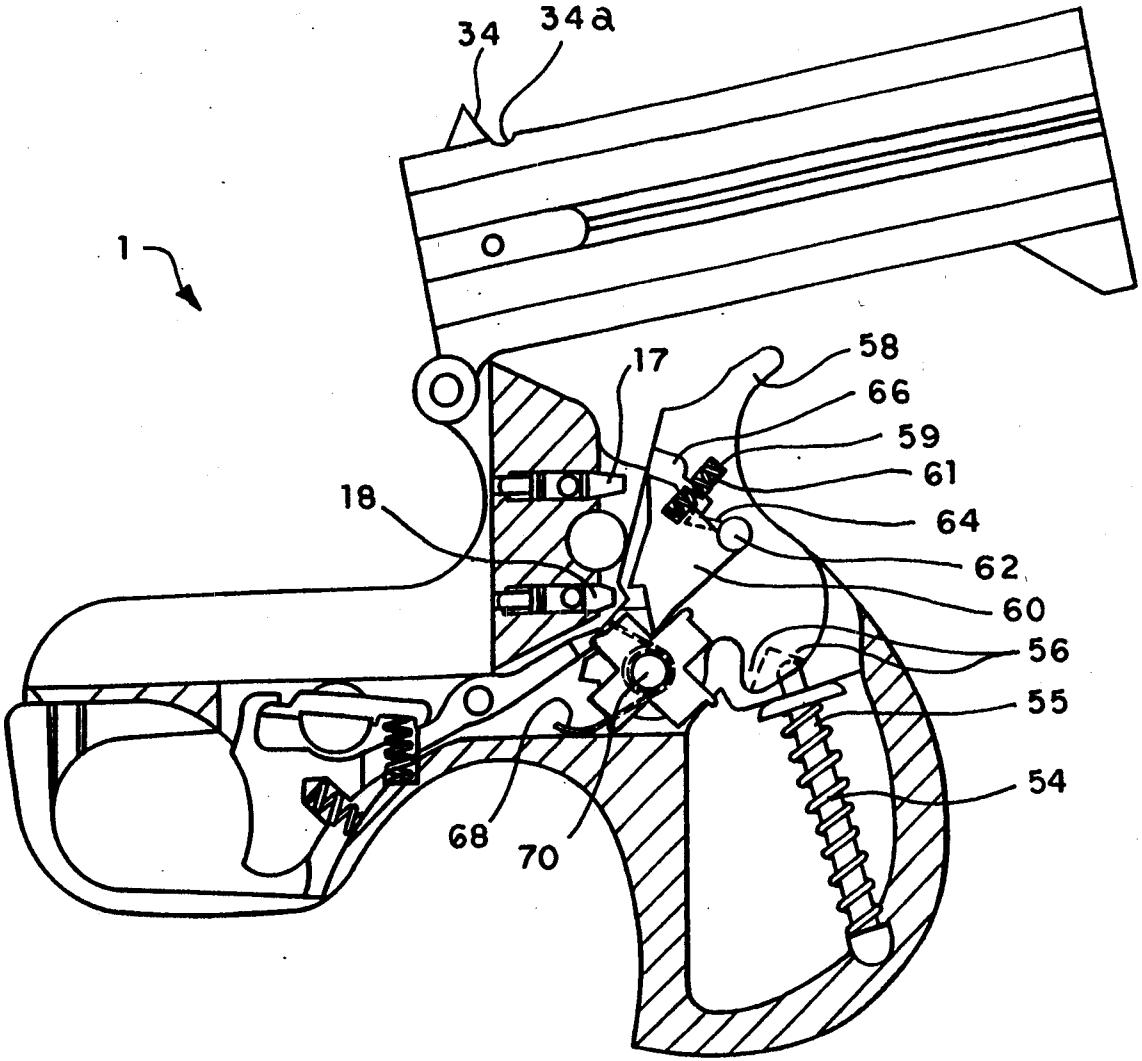
FIG. 3 is a side view in cross section detailing the hammer mechanism and surrounding parts of the gun of FIG. 1.
Figure 4:
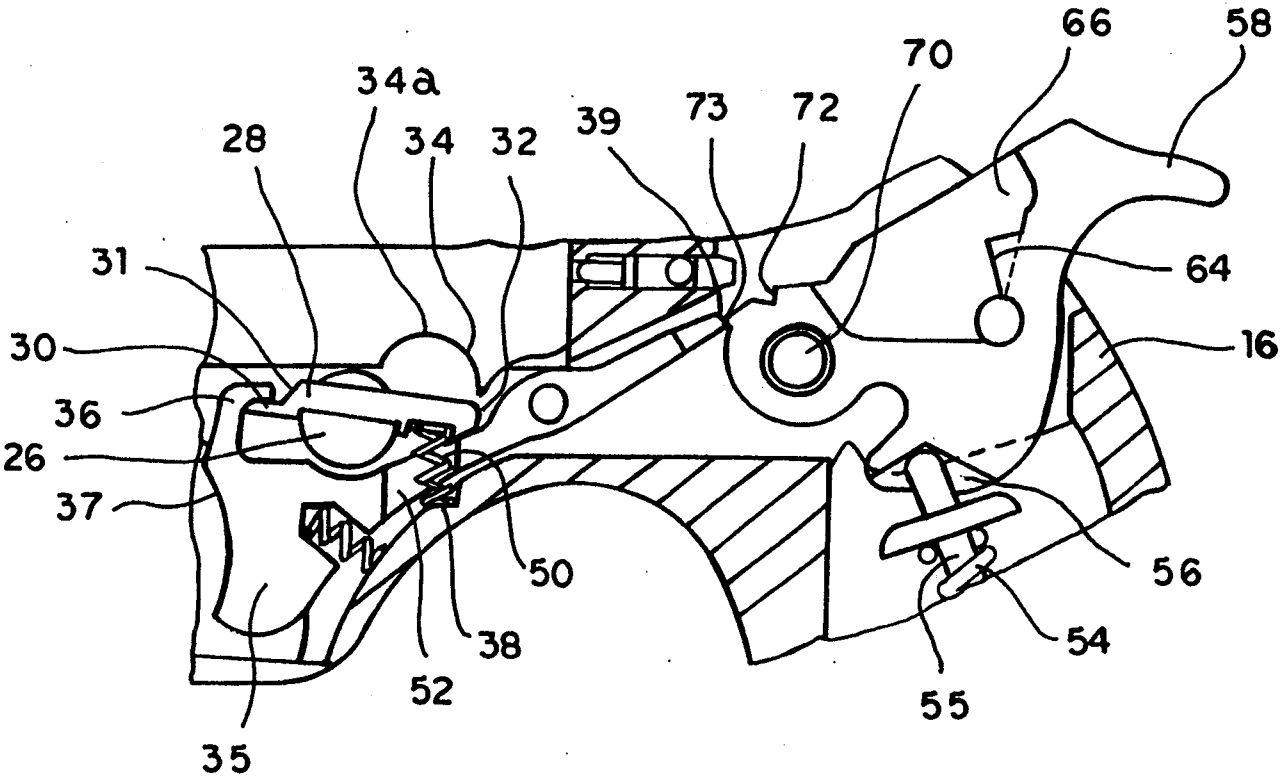
FIG. 4 is an enlarged, partial, side view in cross section through the breech locking mechanism and the trigger portion of the gun of FIG. 1 with the breech locking mechanism in the unlocked position.

When the gun is in its fully cocked position, as shown in FIG. 4, the hammer engaging end 39 of the trigger 35 contacts the hammer full cock notch 73 to secure the hammer in its cocked position. Upon displacement of the finger engaging end 37 of trigger 35, the hammer engaging end 39 of the trigger 35 releases from the hammer full cock notch 73. Referring to FIG. 3, forces from the hammer spring 54 then push the spring plunger 55 against the hammer 58. This propels the hammer 58 and hammer head 60 toward the firing pins 17 and 18. The hammer head 60 strikes one of the firing pins, and the gun 1 is fired. Hammer tangs 56 prevent the spring plunger 55 from exiting its working position during gun recoil.

One aspect of the present invention is directed to an improvement in means by which the hammer 58 is rebounded after firing. As illustrated in FIG. 3, the hammer rebound mechanism incorporates a torsion spring 68 which is wrapped around the hammer pivot pin 70. When the gun 1 is fired, forces from the hammer spring 54 rotate the hammer 58 to a position in contact with either firing pin 17 or firing pin 18. This rotation increases the tension of the torsion spring 68 so that the torsion spring 68 automatically pulls the hammer 58 to a rebound position, out of contact with the firing pins 17 and 18. This rebounding position, depicted in FIG. 2, is such that the hammer 58 is returned far enough that the hammer engaging end 39 of the trigger 35 automatically engages a hammer block notch 72. The contact between the hammer engaging end 39 of the trigger 35 and the hammer block notch 72 holds the hammer 58 apart from firing pins 17 and 18. When in this rebounded position, the hammer 58 does not feel the forces from the spring plunger 55. Therefore, the spring plunger 55 cannot push the hammer 58 toward the firing pins. The result is a device which aids in the prevention of accidental discharge when the barrel 10 is moved into the firing position.

Another improvement in a gun in accordance with the present invention can be seen in FIG. 3. This improvement comprises means for assuring that the hammer head 60 remains flush against the outside wall of the hammer head cavity 66. Although it is desired that the hammer head 60 freely pivots about the hammer head pivot pin 62, it is important that the hammer head 60 does not move in a direction perpendicular to the path of movement permitted by the hammer head pivot pin 62. If such undesired movement should result, the hammer head 60 could drag on the internal surface of the frame 16 and therefore prevent the hammer 58 from rebounding properly.

Figure 6:
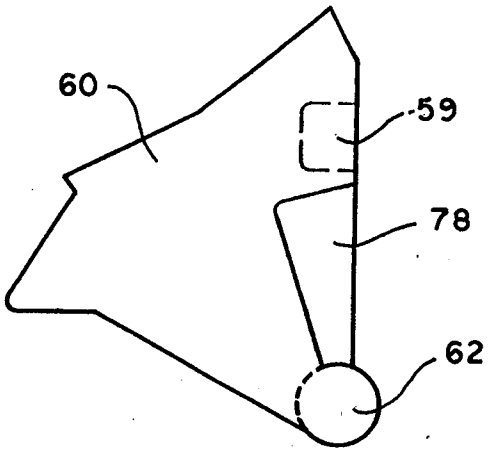
FIG. 6 is a side elevation view of the hammer head of the gun of FIG. 1.
Figure 7:
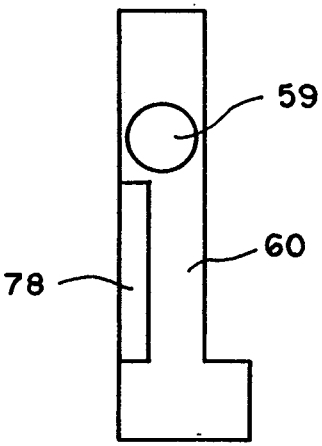
FIG. 7 is a front elevational view of the hammer head of FIG. 6.

The present invention eliminates the danger of unwanted movement of the hammer head 60 by incorporating a hammer tab 64, as seen in FIG. 5. This hammer tab 64 extends from the hammer 58 into the hammer head cavity 66. FIGS. 6 and 7 present the hammer head 60 with a hammer tab cavity 78 which is a hollow section dimensioned to receive the hammer tab 64. As the hammer head 60 rotates within the hammer head cavity 66, a portion of the hammer tab 64 remains inside the hammer tab cavity 78. The tight fit between the hammer tab 64 and the hammer tab cavity 78 prevents the hammer head 60 from movement in a direction perpendicular to the path of movement permitted by the hammer head pivot pin 62. Therefore, the forces resulting from the pressure of the hammer head spring 61, depicted in FIG. 3, on the hammer head 60 will only displace the hammer head 60 in the desired plane of movement. Hammer head spring 61 rests inside hammer head spring cavity 59.

The hammer tab 64 is also instrumental during assembly of the gun 1 when the hammer head 60 is placed into the hammer head cavity 66. Forces from the hammer head spring 61 act against the hammer head 60 and attempt to force the hammer head 60 out of the hammer head cavity 66. However, placing the hammer tab 64 inside the hammer tab cavity 78 maintains the hammer head 60 inside the hammer head cavity 66 and further assembly of the gun 1 may continue.

Figure 9:
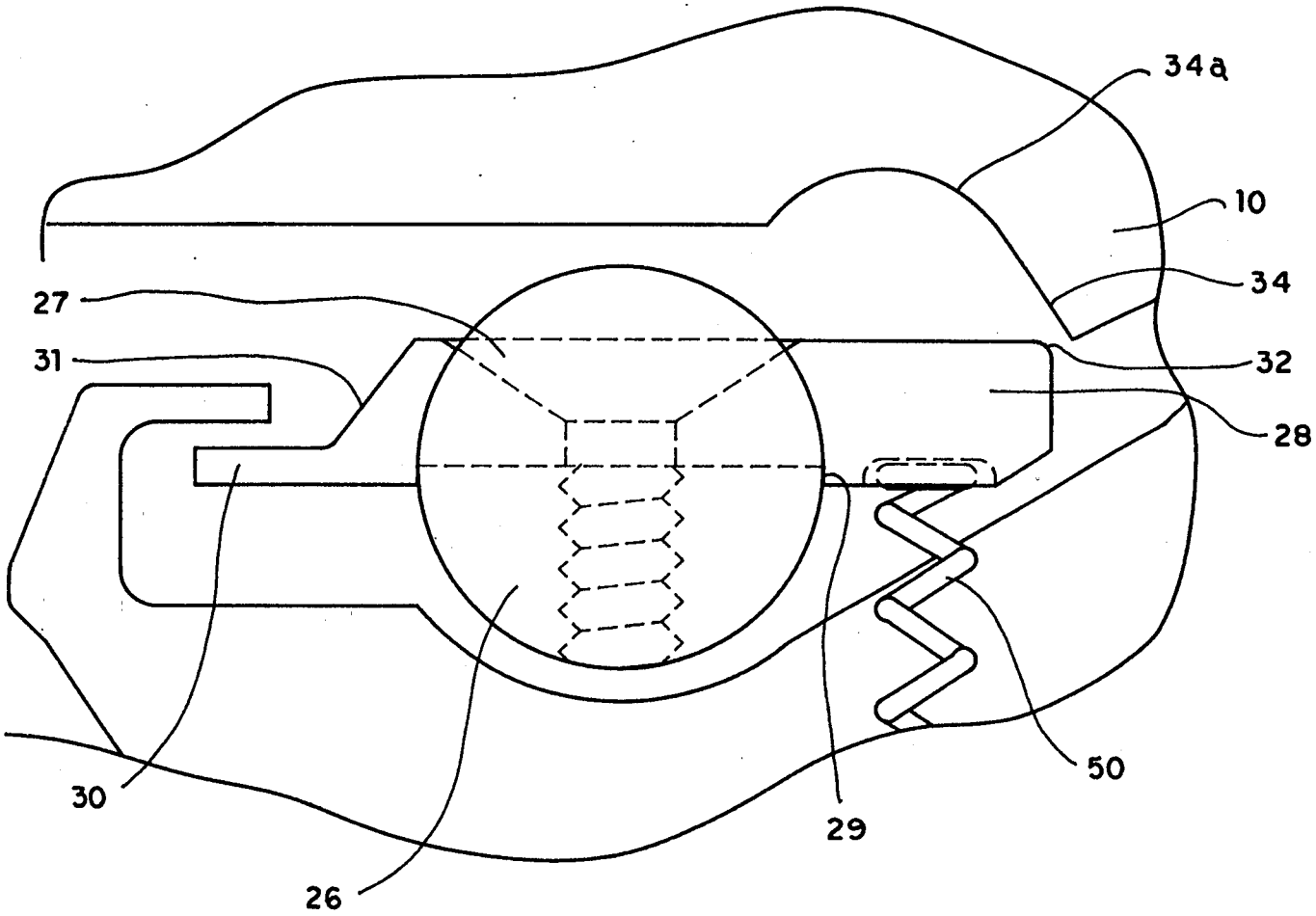
FIG. 9 is an enlarged scale, somewhat diagrammatic view of a portion of the structure for locking and unlocking the barrel from the frame of the gun.

Another improvement in a gun in accordance with the present invention comprises improved means for locking and unlocking the barrel 10 from the frame 16. As can be seen from FIG. 8, the gun 1 comprises a locking lever handle 74 which is rotatable between the locked position 75 and the unlocked position 76. This locking lever handle 74 is attached to a locking lever shaft 26, which is transversely disposed within the frame 16. FIG. 9 shows a screw 27 which attaches this shaft 26 to the locking lever flipper 28 which includes a flipper tab 30 on end 31 and a locking end 32.

The locking lever flipper 28 includes a shear surface 29 which contacts the locking lever shaft 26. Upon firing the gun 1, the barrel 10 exerts force upon the locking lever flipper 28. The contact between the shear surface 29 and the locking lever shaft 26 allows the shear surface 29 to absorb the forces from the barrel 10. If the shear surface 29 were not present, these forces could cause a shear fracture in the screw 27.

When the locking lever handle 74 is displaced into the locked position 75, the surface of the flipper locking end 32 comes into contact with the barrel locking contact surface 34 of the barrel 10. This barrel locking contact surface 34 is angled at approximately 58 degrees with the top portion 21 of the barrel 10. Therefore, only minimal rotation (ie. less than 90 degrees, preferably 45 degrees) of the locking lever handle 74 is required to result in full contact between the flipper locking end 32 and the barrel locking contact surface 34. This makes the locking mechanism more efficient to use than most other pivoting mechanisms which often require a rotation of 180 degrees to lock the barrel in place.

The barrel locking contact surface 34 includes an arcuate portion **34*a*, which is formed from a radius of approximately 0.125 of an inch. The locking lever spring 50 forces the surface of the flipper locking end 32 against this arcuate portion 34*a*. As illustrated in FIG. 4, the locking lever spring 50 has one end which engages the locking lever flipper 28 and one end that is situated on a spring boss 38. In the preferred embodiment of the invention, the locking lever spring 50 protrudes through a hole 52 in the trigger 35. The tension of the locking lever spring 50 which forces the surface of the flipper locking end 32 against the arcuate portion 34*a* of the barrel locking contact surface 34, also forces the breech end 14 of the barrel 10 against the barrel receiving portion 22 of the frame 16. This results is a tighter match, barrel 10 to frame 16**. Therefore, the locking mechanism allows for wider manufacturing tolerances and is also beneficial in interchanging a gun frame with a plurality of barrels which may have dimensions which vary from each other.

When the locking lever handle 74 is rotated to the unlocked position 76, the breech end 14 of the barrel 10, as shown in FIG. 2, may be pivoted away from the barrel receiving portion 22 of the frame 16. This rotation of the locking lever handle 74 consequently pivots the locking lever flipper 28 so that the contact between the flipper locking end 32 of the locking lever flipper 28 and the barrel locking contact surface 34 of the barrel 10 is terminated. This leaves the barrel 10 unobstructed to pivot about the pivot pin 24.

It is important to ensure that the locking lever handle 74 cannot be rotated with such force that it causes the locking lever flipper 28 to contact the trigger 35 thus resulting in an accidental discharge. To alleviate this danger, both the trigger 35 and the locking lever flipper 28 are equipped with tabs whose engagement to each other limits the overall rotation of the locking lever flipper 28. When the locking lever flipper 28 is in the unlocked position, as shown in FIG. 4, the overall clockwise rotation of the locking lever flipper 28 is hindered by the contact of the trigger tab 36 and the flipper tab 30.

A second advantage resulting from the contact of the trigger tab 36 to the flipper tab 30 occurs during the firing of the gun 1. When the trigger 35 is pulled, the trigger tab 36 displaces the flipper tab 30. This rotates the locking lever flipper 28 so that the flipper locking end 32 of the locking lever flipper 28 is secured against the barrel locking contact surface 34 of the barrel 10. This ensures at least minimal locking of the barrel 10 to the frame 16 during firing.

Referring to FIG. 2, in the event excessive powder residue accumulates on the breech 14 of the barrel 10, this barrel 10 would not meet flush with the barrel receiving portion 22 of the frame 16. When the trigger 35 is pulled in an attempt to fire the gun 1, the displacement of the barrel 10 causes the flipper locking end 32 to engage a point of the barrel 10 adjacent to the barrel locking contact surface 34 of the barrel 10. This engagement impedes the flipper locking end 32 from rotating to the barrel locking contact surface 34 of the barrel 10. This prevention of the full rotation of the locking lever flipper 28 limits the downward movement of the trigger tab 36 and, correspondingly, prevents displacement of the trigger 35. Therefore, the gun 1 may not be fired.

It is to be understood that the present invention is not limited to the sole embodiment described above, but encompasses any and all embodiments within the scope of the following claims.

We claim:

1. A gun comprising:

a frame with a barrel receiving portion, a trigger portion, and a handle;

a barrel having a top portion, a muzzle end and a breech end, said barrel breech end being pivotally secured to said barrel receiving portion of said frame, thereby allowing said barrel to rotate between a firing position and a loading position;

at least one firing pin dimensioned and configured to extend from and retract into said frame;

a trigger with a finger engaging end and a hammer engaging end;

a hammer and a hammer pivot pin pivotally attaching said hammer to said frame; and a torsion spring attached to said hammer pivot pin whereby said torsion spring aids in the rebounding of said hammer.

2. A gun in accordance with claim 1, wherein said hammer further comprises a hammer block notch to engage said hammer engaging end of said trigger.

3. A gun in accordance with claim 1, further comprising a breech locking mechanism for securing said barrel in said firing position, said breech locking mechanism comprising:

a locking lever shaft disposed within said frame;

a locking lever handle attached to said locking lever shaft and movable between a locked position wherein said barrel is secured in the firing position and an unlocked position wherein said barrel may pivot between the firing position and the loading position;

a locking lever flipper attached to said locking lever shaft, said locking lever flipper having a flipper tab end and a locking end; and a barrel locking contact surface on said barrel wherein said barrel locking contact surface engages said locking end of said locking lever flipper when said locking lever handle is in the locked position.

4. A gun in accordance with claim 3 wherein said trigger further comprises a trigger tab extending outwardly from said trigger, said trigger tab being configured to engage said flipper tab end of said locking lever when said locking lever is in the unlocked position.

5. A gun in accordance with claim 3, further comprising:

a spring boss attached to said frame; and a locking lever spring with a first end and a second end, said first end being attached to said spring boss, said second end being attached to said locking lever flipper.

6. A gun in accordance with claim 5 wherein said trigger includes means defining a hole through which said locking lever spring is mounted.

7. A gun in accordance with claim 3, wherein said locking lever flipper further comprises a shear surface.

8. A gun in accordance with claim 3 wherein the angle defined by said barrel locking contact surface and said barrel top portion is of or about 58 degrees.

9. A gun in accordance with claim 3, wherein said barrel locking contact surface includes an arcuate portion.

10. A gun in accordance with claim 9, wherein said arcuate portion is formed from a radius of approximately 0.125 of an inch.

11. A gun in accordance with claim 1 further comprising:

a spring plunger engaging said hammer; and at least one hammer tang extending from said hammer in a location adjacent to the contact point of the spring plunger and the hammer.

12. A gun in accordance with claim 1, further comprising a hammer head pivotally attached to said hammer and a hammer tab attached to said hammer, said hammer including means defining a hammer head cavity for the placement of said hammer head, said hammer head including means defining a hammer tab cavity for receiving said hammer tab.

13. A gun in accordance with claim 1 wherein the number of said at least one firing pin is two.

14. A gun comprising:

frame with a barrel receiving portion, a trigger portion, and a handle;

a barrel having a top portion, a muzzle end and a breech end, said barrel breech end being pivotally secured to said barrel receiving portion of said frame thereby allowing said barrel to rotate between a firing position and a loading position;

at least one firing pin dimensioned and configured to extend from and retract into said frame;

a trigger with a finger engaging end and a hammer engaging end;

a hammer and a hammer pivot pin pivotally attaching said hammer to said frame;

a locking lever shaft disposed within said frame;

a locking lever handle attached to said locking lever shaft and movable between a locked position wherein said barrel is secured in the firing position and an unlocked position wherein said barrel may pivot between the firing position and the loading position;

a locking lever flipper attached to said locking lever shaft, said locking lever flipper having a flipper tab end and a locking end; and a barrel locking contact surface on said barrel wherein said barrel locking contact surface engages said locking end of said locking lever flipper when said locking lever handle is in the locked position;

said barrel locking contact surface and said barrel top portion defining an angle on the order of 58 degrees.

15. A gun in accordance with claim 14, wherein said barrel locking contact surface includes an arcuate portion.

16. A gun in accordance with claim 15, wherein said arcuate portion is formed from a radius of approximately 0.125 of an inch.

17. A gun in accordance with claim 14, wherein said locking lever flipper further comprises a shear surface.

* * * * *